US005080301A

United States Patent [19]

Knoche et al.

[11] Patent Number: 5,080,301

[45] Date of Patent: Jan. 14, 1992

[54] GLIDE MISSILE

[75] Inventors: Hans-Georg Knoche, Oberhaching; Lothar Stiklorus, Ottobrunn, both of Fed. Rep. of Germany

[73] Assignee: Messerschmitt-Bölkow-Blohm Gessellschaft mit beschränkter Haftung

[21] Appl. No.: 23,524

[22] Filed: Mar. 7, 1979

[30] Foreign Application Priority Data

Mar. 25, 1978 [DE] Fed. Rep. of Germany ..... 2813032

[51] Int. Cl.[5] ..... F41G 7/00; F42B 10/02

[52] U.S. Cl. ..... 244/3.22; 244/3.1; 244/3.23; 244/3.24; 244/52; 244/78

[58] Field of Search ..... 244/3.21-3.29, 244/3.1, 45 A, 207, 213, 78, 52

[56] References Cited

U.S. PATENT DOCUMENTS

| | | | |
|---|---|---|---|
| 3,195,462 | 7/1965 | Petre | 244/3.21 |
| 3,276,376 | 10/1966 | Cubbrson et al. | 244/3.22 |
| 3,278,140 | 10/1966 | Evans | 244/3.22 |
| 3,588,003 | 6/1971 | Johnston | 244/3.22 |
| 3,610,267 | 10/1971 | Warren | 244/3.22 |
| 3,770,226 | 11/1973 | Kranz | 244/3.21 |
| 3,854,678 | 12/1974 | Geres | 244/3.22 |

FOREIGN PATENT DOCUMENTS

| | | | |
|---|---|---|---|
| 1257614 | 2/1961 | France | 244/3.21 |
| 1517053 | 7/1978 | United Kingdom | 244/3.24 |

*Primary Examiner*—Harold J. Tudor
*Attorney, Agent, or Firm*—Toren, McGeady & Associates

[57] ABSTRACT

A glide missile is provided with trimming devices for affording a positive angle of incidence. The trimming devices are controlled by the combination of a fluidic element through which ram flows and a gyroscopically controlled shutter.

11 Claims, 2 Drawing Sheets

GLIDE MISSILE

SUMMARY OF THE INVENTION

The invention relates to a glide missile with aerodynamic trim means for generating a positive angle of incidence of the missile body which trim means are movably connected to the missile body.

As a result of the positive angle of incidence relative to the tangent to the trajectory, glide missiles of this type fly on a very flat trajectory. However, if the forces resulting from the trim arrangement are not located in a vertical plane extending through the axis of the missile, this results in lateral deviation of the trajectory. Accordingly, in the German Auslegeschrift 1,094,159, it has been suggested to stabilize the trim arrangements in their attitudes relative to the roll axis by means of pendulum arrangements which respond to gravity.

However, a roll stabilization of the trim means by means of a pendulum is not possible in principle, since missile and pendulum are equally accelerated in the same direction and, thus, do not move relative to each other. Accordingly, it is also not possible by means of pendulum forces to control the trim means on missiles and to stabilize them in their attitudes.

Therefore, it is the task of the invention to provide a glide missile in which the trim means can be stabilized in a simple manner in respect to their attitudes relative to the roll axis. In accordance with the invention, this task is solved thereby that the trim means are controllable by means of ram air.

When the adjusting forces for actuating the trim means are taken from the ram air, for the transmission of control signals, for example, by means of an attitude control, now only very small forces are required, so that the reaction forces on the attitude control are also very small. Accordingly, it is possible to use conventional reference indicators, such as, for example, gyroscopes.

The use of ram air for the generation of moments of rotation in missiles is known from the U.S. Pat. No. 3,977,629. However, for such a generation of moments for roll stabilization of the entire glide missile, very cumbersome apparatus is required, such as, large air passages, fluid amplifiers, etc., which, in addition, would have to be accommodated in a large portion of the interior of the missile.

A roll stabilization of the trim means can be carried out by means of a gyro-controlled fluidic element which is operated by ram air. The moments which must be generated for the roll stabilization are reduced when the trim means are arranged on a missile tip or cone which is rotatable about the longitudinal axis of the missile. Accordingly, for adjustments in respect to rolling, merely the moments of inertia of the trim means and the missile tip must be overcome. The remaining missile body may roll, for example, due to slightly inclined tail fins, in order to compensate deviations from the trajectory resulting from errors due to design or thrust. The trim means may also be arranged behind the center of gravity of the missile in respect to the direction of flight.

The trim means have been found particularly suitable. The control of such trim means which are constructed as fins may be carried out by the controlled flow of the ram air from the outlets of the fluidic elements. In this regard, the arrangement of flow from the fins is very simple in its design, while the use of separate regulation facilities higher roller moments.

By means the adjustment of the fins in dependence on the magnitude of the ramming pressure, the roll position as well as the lift generated by the trim means may be varied.

Additional embodiments of controllable trim means includes the use of spoilers.

BRIEF DESCRIPTION OF THE DRAWING

In the following, the invention shall be described with the aid of the embodiments which are, partly schematically, shown in the figures. In the drawing.

DETAILED DESCRIPTION OF THE INVENTION

Figure 1:
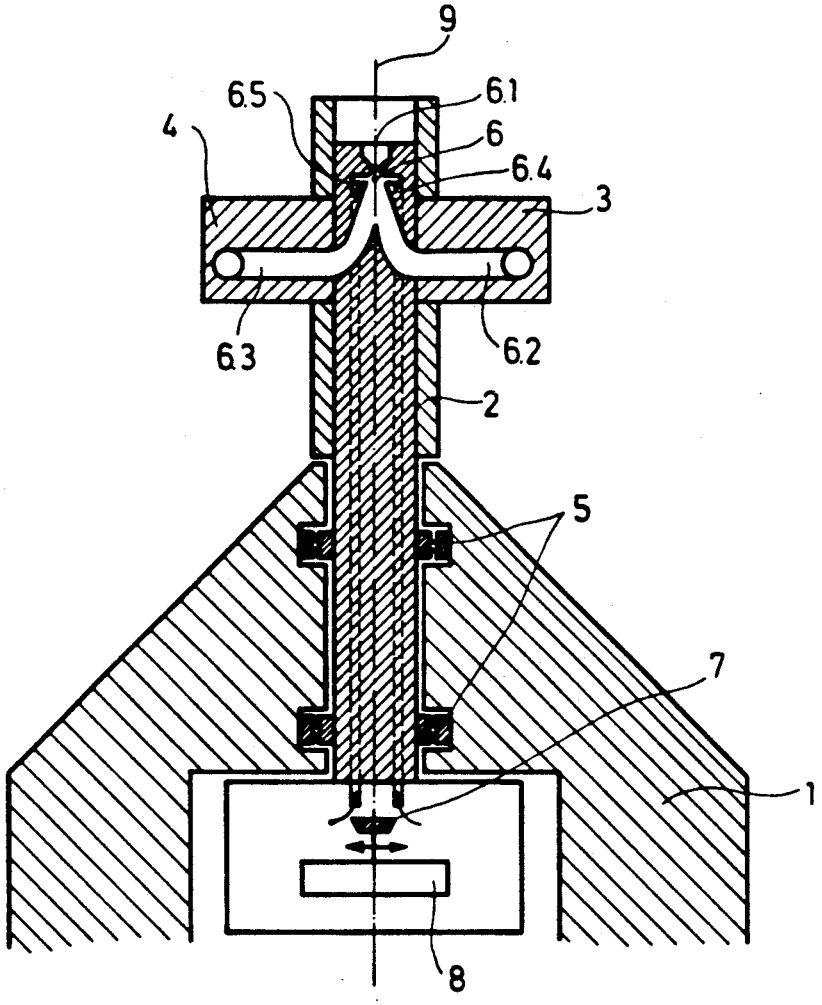
FIG. 1 shows a horizontal section through the front portion of a glide missile with trim means constructed as fins.

A cylindrical tip or cone 2 is arranged on a glide missile 1. At the tip, trim means arranged in the form of fins 3 and 4 which impart a lift to the tip of the missile and, thus, a positive angle of incidence to the entire missile relative to the tangent to the trajectory. The missile tip 2 is rotatably supported relative to the missile body 1 by means of two radial bearings 5 which have a sufficiently large axial distance between each other. The double support is advantageous for absorbing the moments which result from the lift of the fins and the weight of the tip. In the interior, of the tip 2, in the region of the fins, fluidic element 6 is arranged into whose inlet 6.1 ram air flows in during flight. The outlets 6.2 and 6.3 of the fluidic element end underneath the fins 3 and 4, so that the ram air flowing out of one of the outlets imparts a moment of rotation to the tip 2. For the control of the fluidic element 6, two control lines 6.4 and 6.5 lead to a shutter 7 which is controlled by a gyroscope 8. Depending on the roll position of the tip 2 or the fins 3 and 4, this shutter 7 closes one of the two control lines and opens the other. Subsequently, the ram air flowing in at 6.1 is conducted to that outlet on whose side the control line is closed. As a result, the missile tip 2, the fins 3 and 4 and the attitude control 6,7,8 form a roll-stabilized system which is independent from the roll position of the missile 1.

Figure 2:
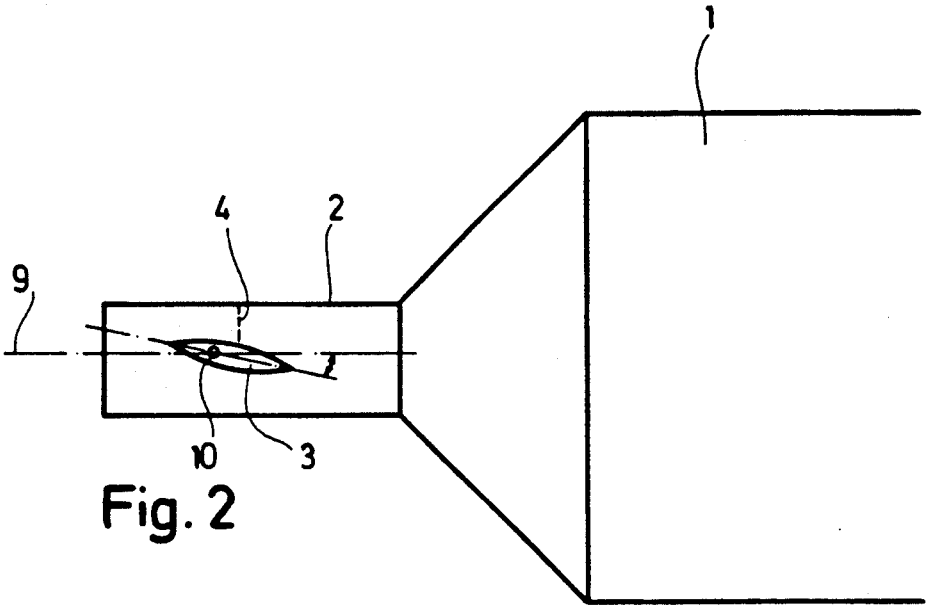
FIG. 2 shows a side view of the front portion of a glide missile with adjustable fins.

FIG. 2 shows a side view of the front portion of a glide missile. As in the above-mentioned example, the missile body 1 has a missile tip 2 which is rotatable about the roll axis 9. On the missile tip 2 there are also arranged trim means in the form of fins 3 and 4 which, however, contrary to the preceding example, are not rigidly connected to the missile tip, but are mounted so as to be rotatable about an axis 10. The angles of incidence $\alpha$of both fins 3 and 4 can be adjusted independently from each other by means of control members, not shown in detail, which are operated by ram air. Also in this case, a gyro-controlled fluid element can be used as the reference indicator for controlling the control members.

Figure 3:
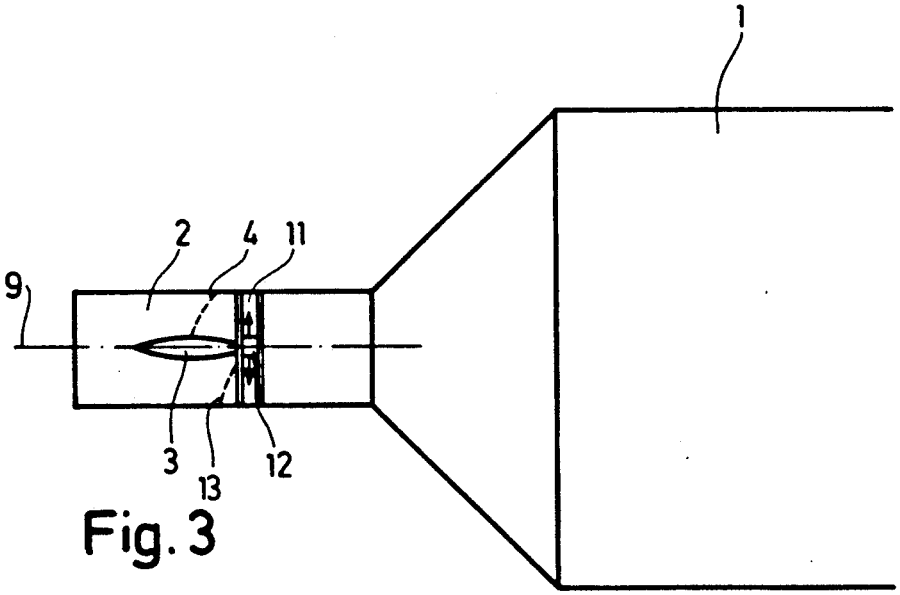
FIG. 3 shows a side view of the front portion of a glide missile with stationary fins, and adjustable spoilers.

As in the preceding embodiments, in the side view of the front portion of a glide missile shown in FIG. 3, fins 3 and 4 are arranged on a missile tip 2 which is rotatable about the roll axis 9. As in the first embodiment, the fins 3 and 4 are in this case rigidly connected to the missile tip 2. Spoilers 12 and 13 are arranged parallel relative to the trailing edges of the fins 3 and 4 on a ring 11 which is rotatable relative to the missile tip 2. By a rotation of the ring 11, the spoiler on one side is moved above the trailing edge of one fin and the spoiler on the other side is moved underneath the trailing edge of the fin. The resulting different approach flows toward the fins 3 and 4 create a moment of rotation which causes the entire tip of the missile including the fins to rotate about the roll axis 9. The spoilers are also controlled by means of a gryo-controlled fluidic element, not shown, which has control members which are arranged at the outlets and are operated by ram air.

I claim:

1. Glide missile including a missile body having a longitudinal axis, said missile body having a forward end and trailing end and trim means mounted on said missile body for generating a positive angle of incidence of said missile body, wherein the improvement comprises a missile tip rotatably mounted on the forward end of said missile body, said trim means located in said missile tip, means associated with said trim means for receiving ram air in said missile tip and controlling the flow of the ram air through said trim means for adjustably positioning said trim means, said ram air control means comprising a fluidic element arranged to receive ram air and having an inlet opening in said missile tip and facing in the forward direction of said missile body, said fluidic element including a pair of outlets and a pair of control lines with each said control line associated with a different one of said outlets and means associated with said pair of control lines for opening one of said outlets and closing the other one of said outlets for controlling the flow of ram air through said trim means.

2. Glide missile, as set forth in claim 1, wherein said ram air control means being arranged for roll-stabilizing said trim means.

3. Glide missile, as set forth in claim 2, wherein said fluidic element comprises a bistable fluidic element said pair of outlets from said fluidic element located in angularly spaced apart relation about the longitudinal axis of said missile body in said trim means, a shutter located in said missile body, a gyroscope mounted in said missile body for controlling said shutter, said control lines connected to said shutter for selectively controlling flow from said outlets.

4. Glide missile, as set forth in claim 1, wherein said trim means comprises a pair of fins.

5. Glide missile, as set forth in claim 4, wherein said fins are symmetrically angularly spaced apart on said missile tip relative to the longitudinal axis of said missile body, and each of said outlet lines being associated with a different one of said fins and opening from the trailing side of said fin with which it is associated.

6. Glide missile, as set forth in claim 4, wherein said fins are symmetrically angularly spaced apart on said missile cone relative to the longitudinal axis of said missile body and the angle of incidence of said fins being separately adjustable.

7. Glide missile, as set forth in claim 6, wherein the angle of incidence of said fins being equally adjustable in dependence on the magnitude of pressure of the ram air.

8. Glide missile, as set forth in claim 4, wherein said trim means comprise controllable spoilers located in the region of said fins.

9. Glide missile, as set forth in claim 5, wherein said fins are rigidly connected to said missile tip.

10. Glide missile, as set forth in claim 5, wherein the axis of said fins mounted on said missile cone extends transversely on the longitudinal axis of said missile body.

11. Glide missile, as set forth in claim 5, wherein said fins are movably connected to said missile body about an axis extending perpendicularly of the longitudinal axis of said missile body.

* * * * *